US006076784A

United States Patent [19]

Selker

[11] Patent Number: 6,076,784

[45] Date of Patent: Jun. 20, 2000

[54] CONTINUOUS MOVING KEYBOARD/WRIST REST

[75] Inventor: Edwin J. Selker, Palo Alto, Calif.

[73] Assignee: International Business Machines Corporation, Armonk, N.Y.

[21] Appl. No.: 09/288,668

[22] Filed: Apr. 9, 1999

[51] Int. Cl.[7] ..... B68G 5/00; B43L 15/00

[52] U.S. Cl. ..... 248/118; 248/118.1; 248/118.3; 248/918

[58] Field of Search ..... 248/918, 118, 248/118.3, 188, 188.3

[56] References Cited

U.S. PATENT DOCUMENTS 5,145,270 9/1992 Darden ..... 248/118.3
5,257,767 11/1993 McConnell ..... 248/918
5,374,018 12/1994 Daneshvar ..... 248/118
5,435,508 7/1995 Deuitch et al. ..... 248/118
5,568,907 10/1996 Wolfe et al. ..... 248/118
5,601,264 2/1997 Peart ..... 248/118.1
5,685,235 11/1997 Allan ..... 248/918

*Primary Examiner*—Ramon O. Ramirez
*Assistant Examiner*—Jerome A. DeLuca
*Attorney, Agent, or Firm*—Lacasse & Associates; Randy W. Lacasse; Richard M. Ludwin

[57] ABSTRACT

An apparatus and method of adjusting the height and/or angle of a keyboard/wrist rest during use. A modified standard keyboard includes a processor, motors, motor controllers, and height adjusting legs to create a keyboard device which changes angle over time. In an alternative embodiment, a retrofit solution for existing keyboards is disclosed. The keyboard may be adjusted incrementally, infinitely, by a pattern, or impulse over a period of time.

39 Claims, 7 Drawing Sheets

CONTINUOUS MOVING KEYBOARD/WRIST REST

BACKGROUND OF THE INVENTION

1. Field of Invention

The present invention relates generally to the field of ergonomic keyboards. More specifically, the present invention is related to a method and apparatus which provides continuous movement of a computer keyboard and associated wrist rest, movement to include height and angle changes.

2. Discussion of Prior Art

Throughout the development of the PC, various efforts have been practiced to ergonomically enhance the keyboard. Many designs have included height or angle adjustments. Typical keyboards have user adjustable legs which extend from the underside and raise the back or front of the keyboard to an angle comfortable to the user. The user is required to turn the keyboard over and individually adjust each leg in height. While these adjustments may provide some additional level of comfort, they may not be used properly, or at all, for terminals which are frequented by multiple users. Without the active participation of the user, the keyboard will remain in the previous adjustment position throughout the use period. The prior art has failed to provide either an easy adjustment method, i.e. adjustment from the top of the keyboard, an automatically adjustable keyboard or a continuously adjustable keyboard. The following patents include various prior art methods of wrist rest height adjustment, but each fail to include the graphic, electronic, or computer controlled continuous adjustment of a keyboard/wrist rest as per the present invention.

The patent to Daneshvar (U.S. Pat. No. 5,374,018) allows for the adjustment of keyboard height as well as its angulation. One or more inflatable balloons are used to implement the height adjustment. The balloons may be filled with air or with liquids, e.g., water, inert oil, or gel. Further adjustment of keyboard height and angulation is implemented by using flat boards, boards of different shapes or screws (FIG. 16). The boards are located in a space under the keyboard unit. Soft pads comprised of mosaics of soft plastic bubbles provide for wrist and palm comfort.

The patent to Deuitch et al. (U.S. Pat. No. 5,435,508) provides for a Wrist Rest Support. This reference teaches a bladder having an elongated length, arcuate (bow-curved) cross section, and enclosed sealed ends. A viscous fluid within the bladder provides support for the wrists. An outer shell which is washable and flexible surrounds the bladder and provides a pleasant-to-touch feeling.

The patent to Wolfe et al. (U.S. Pat. No. 5,568,907) provides for a Dynamic Wrist Rest. This reference provides an up and down motion of the wrist by means of an internally-mounted pressure-sensitive air bladder or motorized oblong roller assembly located in this wrist-rest unit.

The patent to Peart (U.S. Pat. No. 5,601,264) provides for a Wrist Rest. This reference incorporates a bladder for holding a fluid. A pump connected to the bladder selectively fills the bladder with fluid and a valve selectively releases the fluid from the bladder. The bladder includes two (2) elongated lobes interconnected by an isthmus. The elongated lobes filled with fluid are used to provide a fluid-cushioned support for the keyboard user's wrists and/or palms.

Whatever the precise merits, features, and advantages of the above cited references, none of them achieve or fulfills the purposes of the present invention. Accordingly, it is an object of the present invention to provide for a method and apparatus for continuously controlling the height or angle of a keyboard and its associated wrist rest.

It is another object of the present invention to provide for a method and apparatus for automatically controlling the height or angle of a keyboard and its associated wrist rest.

It is another object of the present invention to provide computer control of a keyboard and associated wrist rest's height and angle.

It is an additional object of the present invention to provide a GUI to enable easy user selection of possible computer controlled keyboard and associated wrist rest positions.

It is an additional object of the present invention to provide patterned control of a keyboard and associated wrist rest's height and angle.

It is an additional object of the present invention to include a retrofit embodiment of the above described computer controlled keyboard.

These and other objects are achieved by the detailed description that follows.

SUMMARY OF THE INVENTION

The present invention provides an apparatus and method of adjusting the height and/or angle of a keyboard/wrist rest during use. A modified standard keyboard includes a processor, motors, motor controllers and height adjusting legs to create a keyboard device which changes angle over time. In an alternative embodiment, a retrofit solution for existing keyboards is disclosed. The keyboard may be adjusted incrementally, infinitely, according to a pattern or impulse, over a period of time.

DESCRIPTION OF THE PREFERRED EMBODIMENTS

Figure 1:
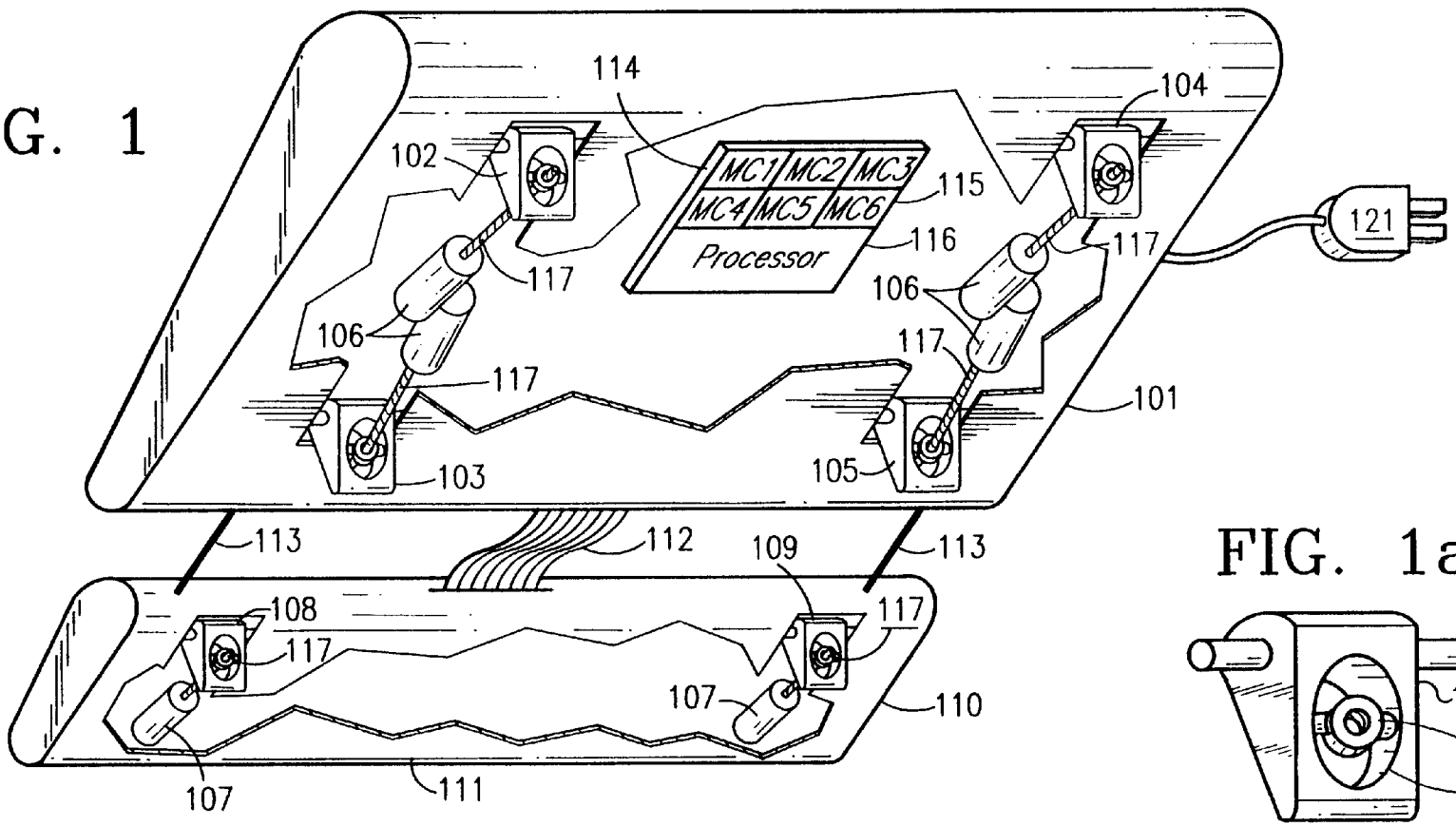
FIG. 1 illustrates an internal component diagram of the present invention as shown from a bottom view.
Figure 1A:
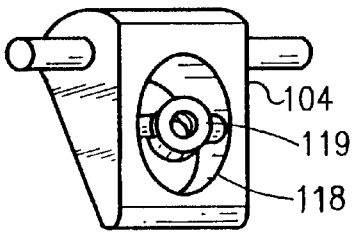
FIG. 1*a* illustrates an enlarged view of the legs of FIG. 1.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications of the materials for its construction and is not intended to limit the invention to the embodiment illustrated. Those skilled in the art will envision many other possible variations within the scope of the present invention.

FIG. 1 illustrates keyboard 100 which can be any PC keyboard, to include various shapes, sizes and styles, e.g. a standard "101-key" keyboard, split-hands or other modified version. Section 101 represents the bottom section of keyboard 100. In a typical keyboard, a plurality of manually adjustable legs extend from the bottom section. Most frequently, only one set of legs will be located along the front or back edge to provide corresponding height adjustment to the front or back of the keyboard. By adjusting the height of the legs, an adjustment to the angle of the keyboard is made. In some cases, a keyboard will include a front and back set to enable multiple adjustments. In the preferred embodiment, keyboard 100 is shown with four legs 102, 103, 104 and 105 located evenly spaced, and in close proximity, to each corner.

Unlike the prior art, each leg has been modified as shown in figure la, to include a hole 118 and pivoting nut 119 receiving threaded rod 117. Each threaded rod 117 extends into the internal cavity of the keyboard 100 and is connected to respective motor 106. Motor 106 is an electric dc motor such as a TMC2832A or equivalent imparting approx. 200 RPM to threaded rod 117. Each motor is secured to the internal keyboard cavity by suitable fasteners known in the art. Alternatively, solenoids can replace the motors and their respective linkages and controllers.

Figure 6:
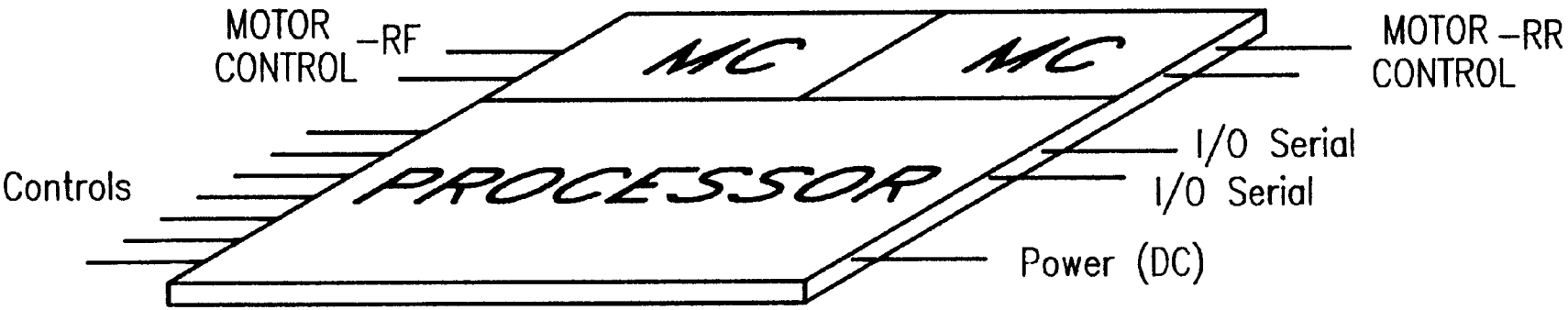
FIG. 6 illustrates a general circuit board layout for the present invention computer controller.

Provided within the internal cavity of the keyboard is a printed circuit board (PCB) 114 which includes a processor module 116 and a multiplicity of motor controllers 115 (see FIG. 6). The processor module includes a processor (CPU) such as the 80C751, associated memory, I/O interfaces, and various power and timing controls (e.g. clock/oscillator not shown). The invention is not to be limited to a specific PCB configuration, known computer boards could be substituted without departing from the scope and spirit of the present invention. DC power is provided to the circuit board and motors through AC/DC adapter 121.

Motor controllers 115 receive electrical signals from the processor and actuate their associated motors 106. Specific electrical connections to the motors 106 are not shown within the drawings, however, any known connection method may be used. In addition, the motor controllers 115 can be located on the PCB or be separated and located individually with each motor 106.

Attached to keyboard 100 is associated wrist rest 110. Wrist rest 110 may comprise a typical gel, foam, or otherwise cushioning material, or include solid non-impact absorbing materials. Wrist rest 110, in the preferred embodiment, is attached to keyboard 100 in a tethered configuration 112. The tethered attachment may include a flexible material or be modified to include an articulating mechanism.

Figure 2:
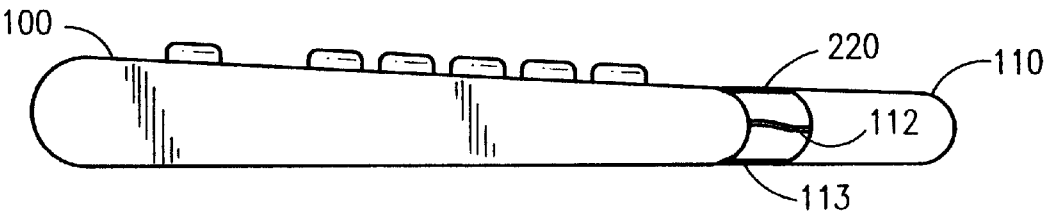
FIG. 2 illustrates a side view of the device shown in FIG. 1.

Wrist rest 110 includes legs 108 and 109, evenly spaced in the outermost corners and which are the same or functionally similar to the legs 102–105 of the keyboard 100. Each leg also includes hole 118 and pivoting nut 119 configuration as previously described and illustrated in figure la. Threaded rods 117 are attached to motors 107 in a similar manner to that described heretofore and are individually activated by associated motor controllers 115 or locally provided controllers. The power and control functions may be provided through connections 113 or be integrated within the tether element 112. FIG. 2 illustrates a side view with the connections shown. A dust cover section "live hinge" 220 prevents dust, debris and other objects, e.g. pens and pencils, from entering the connection area. In an alternative embodiment, wrist rest 110 is made self-sufficient to include its own PCB and associated power (e. g. AC/DC adapter 121) and control elements.

Figure 3B:
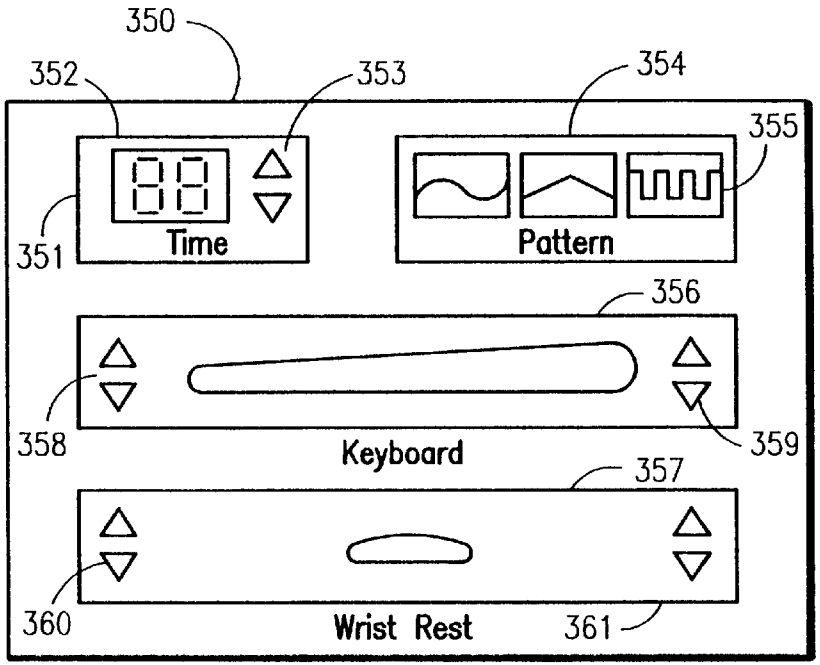
FIG. 3*b* illustrates the GUI controls of the present invention.
Figure 3A:
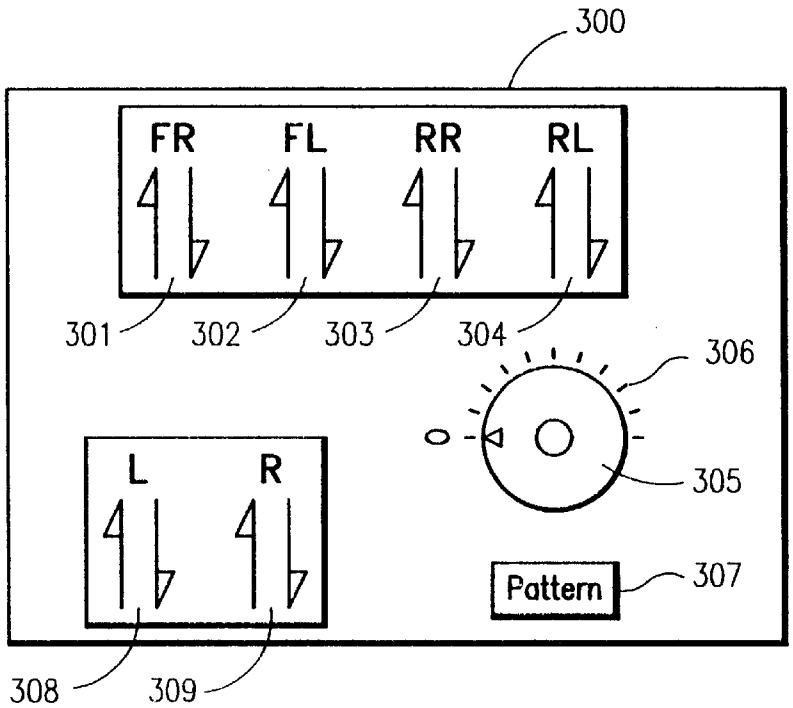
FIG. 3*a* illustrates the keyboard user controls of the present invention.

FIGS. 3*a* and 3*b* illustrate two alternative methods of controlling the keyboard and associated wrist rest. FIG. 3*a* shows a control panel 300 which is located on the top surface of the keyboard or on a separate control box (not shown) controlled by an attached cable or wireless/RF method. The control panel 300 includes a separate up/down selector 301, 302, 303 and 304 for each leg on the keyboard, as well as the wrist rest 308 and 309. The number of controls varies with the number of legs and whether the legs are controlled in groups, e.g. front and back pairs operated simultaneously. In addition, if no wrist rest is provided, controls 308 and 309 are eliminated. Knob 305 allows the operator to select from a range of operating times 306, typically minutes. Section 307 allows the operator to sequence through a list of preselected patterns of adjustment, to be described further hereafter.

FIG. 3*b* illustrates a GUI to enable an operator the ability to make the keyboard and wrist rest height/angle selections as described above on the PC screen. The interface includes: time selection 351 with display 352 and up/down selection 353; pattern selection section 354 with various preselected patterns 355; keyboard height selection 356 with up/down selections for both front 358 and back 359 and wrist rest control 357 with left 360 and right controls 361. Controls 360 and 361 may also be front and back controls depending on leg placement, or be replaced by a single up/down control selection moving both legs simultaneously.

Figure 4:
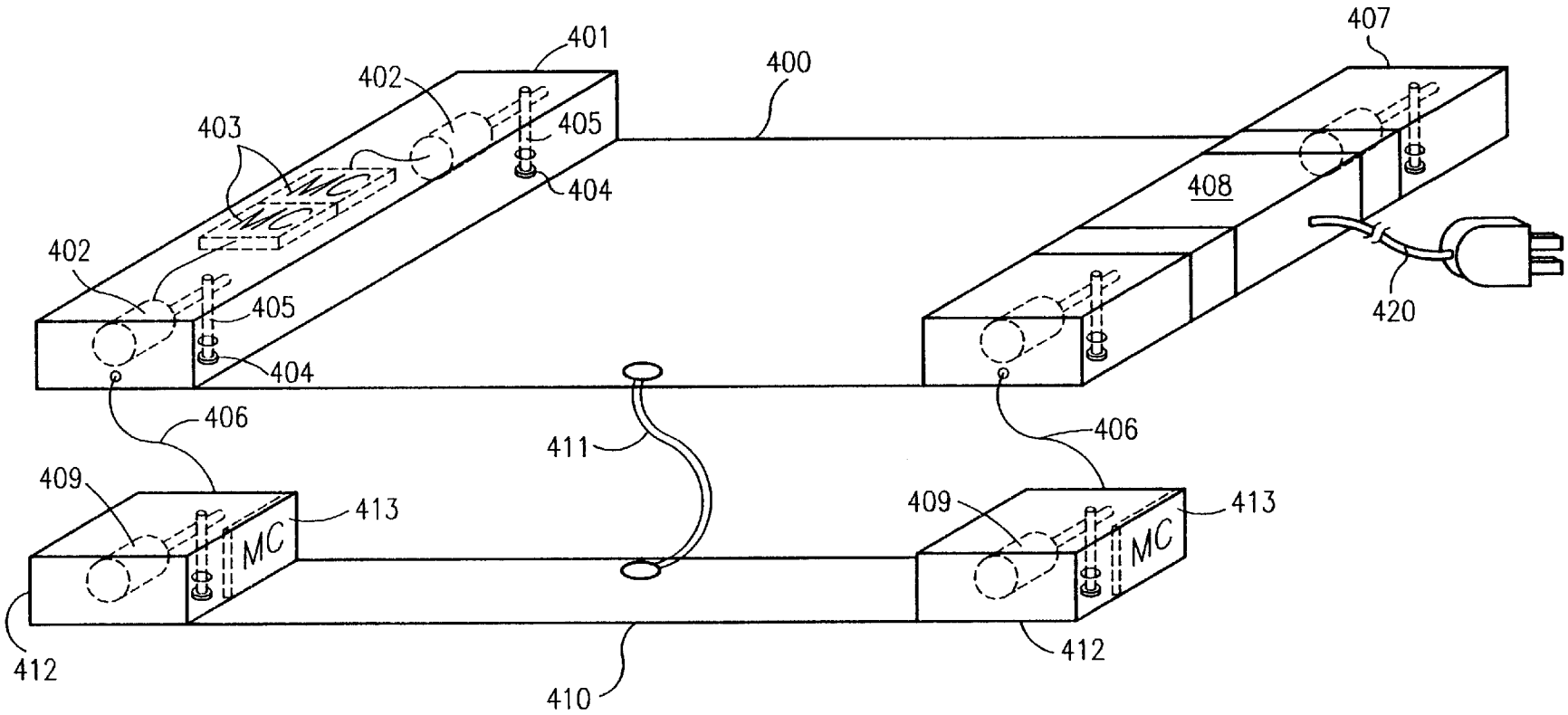
FIG. 4 illustrates a retrofit version of the present invention.

FIG. 4 illustrates a retrofit embodiment of the present invention. The retrofit version comprises a keyboard receiving section 400 and two side sections 401. Sections 400 and 401 are manufactured from sheet metal or polymer compositions or equivalent materials. The side sections contain the motors 402, motor controllers 403, height adjustable legs 404, threaded rods 405 and PCB 408 as described previously in the description of the FIGS. 1–3. A PC keyboard 100 is placed in the keyboard receiving section 400. Instead of the keyboard legs being adjusted, as per the preferred embodiment, the legs extending through the bottom of sections 401 are adjusted in height to adjust the angle of the keyboard. PCB 108 includes, in a preferred embodiment, the motor controllers for the right side motors, with the left side motor controllers 403 being located in close proximity to the left motors 402. Other than the motor controllers and location of the PCB, the left and right sides are to be considered to be symmetrical and include similar elements, power and controls.

An adjustable wrist rest structure includes wrist rest receiving section 410, side sections 412 containing motors 409, height adjustable legs, threaded rods and motor controllers 413 similar to those found in the side sections 401 of the keyboard receiving section. As in the preferred embodiment configuration, the adjustable wrist rest section may be tethered 411 and include power and control connections 406. The retrofit embodiment is controlled by the control panel of FIG. 3*a* located generally over the PCB area 108 and on a top surface of the section 401 (right side). The invention is not limited to a specific location of the control panel. As with the preferred embodiment, the entire retrofit apparatus is alternatively operated from a GUI as shown in FIG. 3*b*.

Figure 5A:
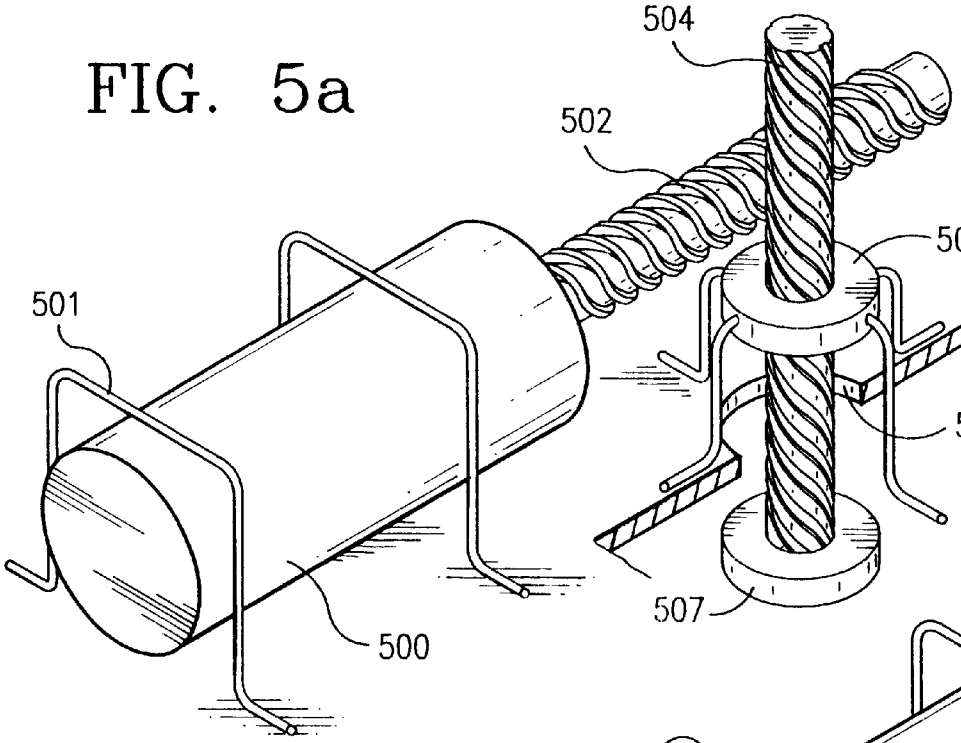
FIG. 5*a* illustrates a motor controlled screw-type height adjuster.
Figure 5B:
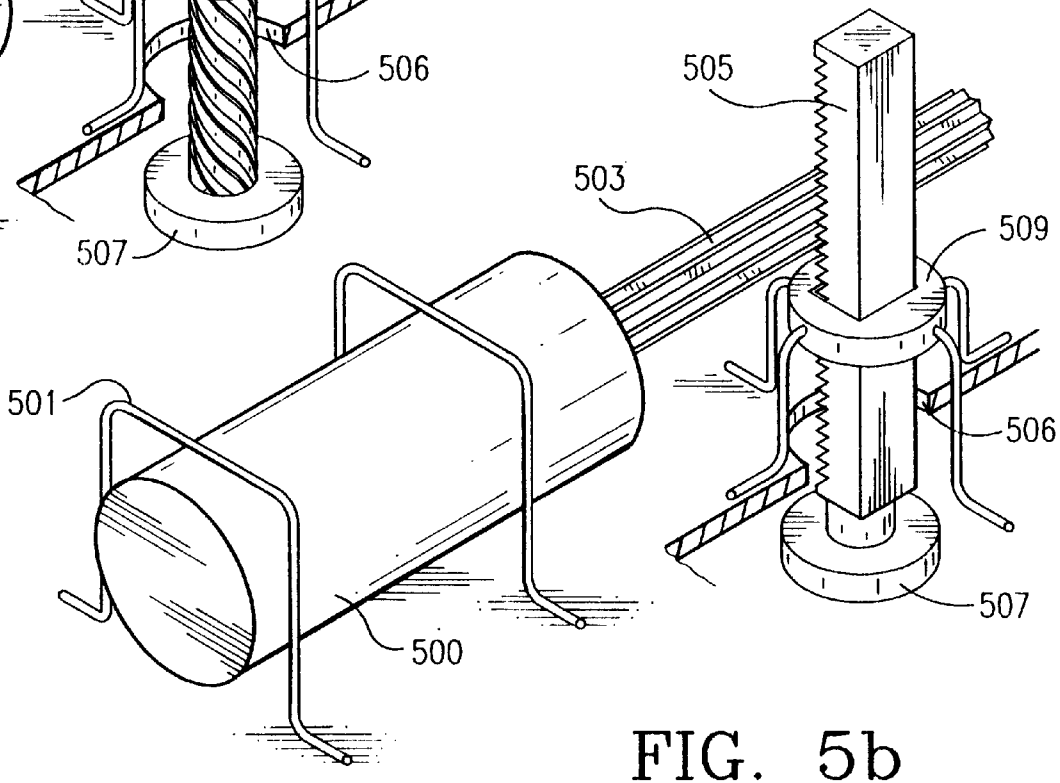
FIG. 5*b* illustrates a motor controlled rack-and-pinion height adjuster.

FIGS. 5*a* and 5*b* illustrate alternative mechanical embodiments of the height adjustable legs and connections to the motors. FIG. 5*a* shows a motor 500, securing clamp 501, screw shaft 502, co-acting screw shaft (threaded rod) 504, shaft retaining ring 509, keyboard case opening 506 and foot 507. Rotating movement of the motor screw shaft 502 is translated into up/down movement of screw shaft 504. FIG. 5*b* illustrates a rack-and-pinion version to include motor 500, securing clamp 501, grooved pinion 503, grooved rack 505, keyboard case opening 506 and foot 507. Rotating movement of the pinion 503 is translated into up/down movement of rack 505.

OPERATION

The operation of the present invention, in both the preferred and retrofit embodiments, is as follows. In a manual mode, under computer/processor control, the user selects either individual leg height adjustments, paired leg adjustments, or multiple leg adjustments to the keyboard, the wrist rest, or both. Upon selection, using the control panel or GUI of FIGS. 3*a* and 3*b* respectively, the processor/computer actuates the appropriate motor controller which in turn rotates the threaded shaft to produce up/down movement of the legs/feet. In a timed mode, the user selects a specified amount of time for the processor/computer to control the raising and lowering of the various legs in either a fixed or a user selectable computer controlled pattern. The processor will adjust the height of the legs of the keyboard and/or wrist rest throughout the time period in a continuous sequence according to prestored patterns stored within the memory of the processor/computer. In a pattern selection mode, the user can select a specific leg adjustment pattern which will be implemented by the computer throughout the computer session until power removal or a new pattern is selected.

Figure 7:
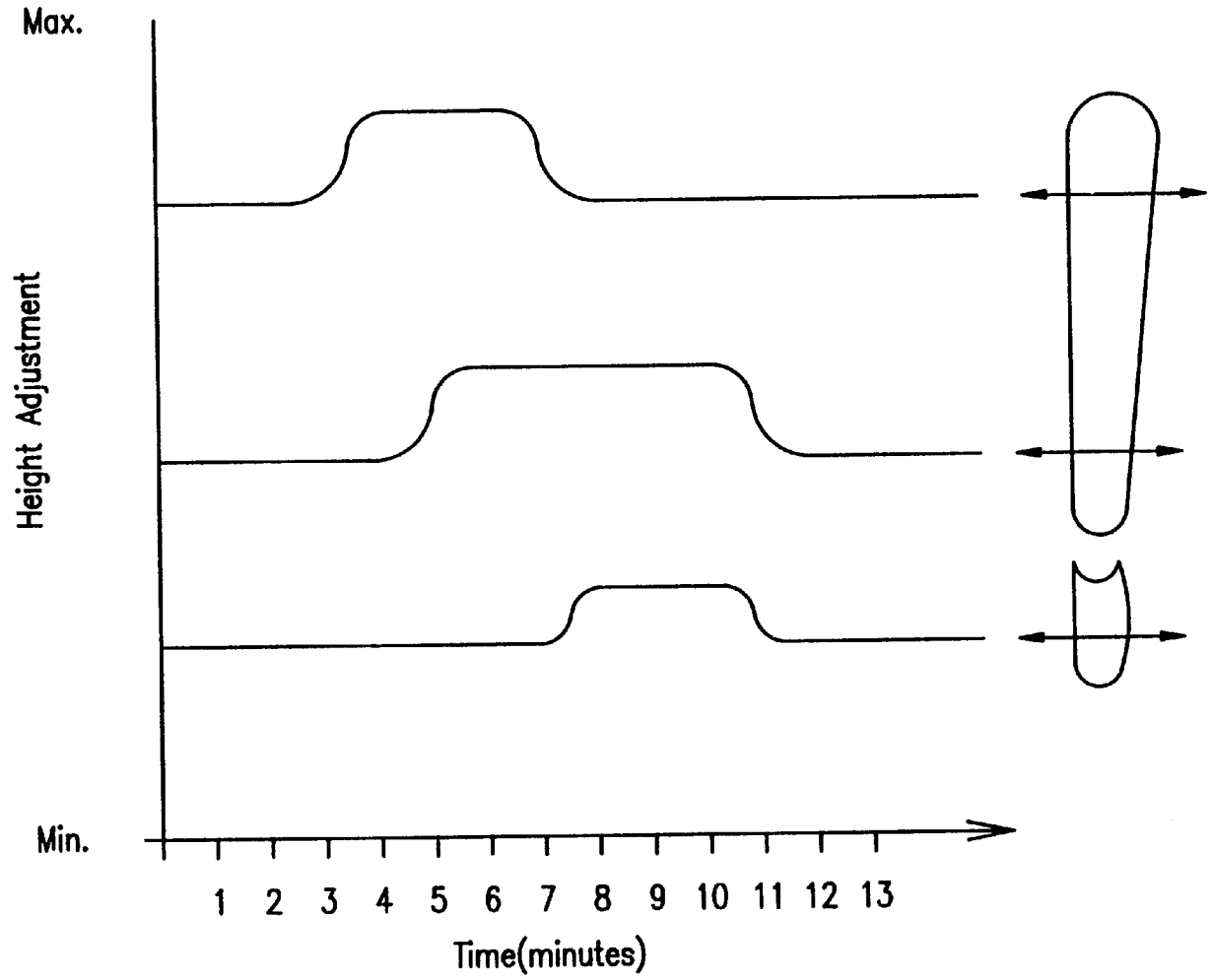
FIG. 7 illustrates a typical height adjustment pattern for each adjustable section of the keyboard and wrist wrest over time.
Figure 8:
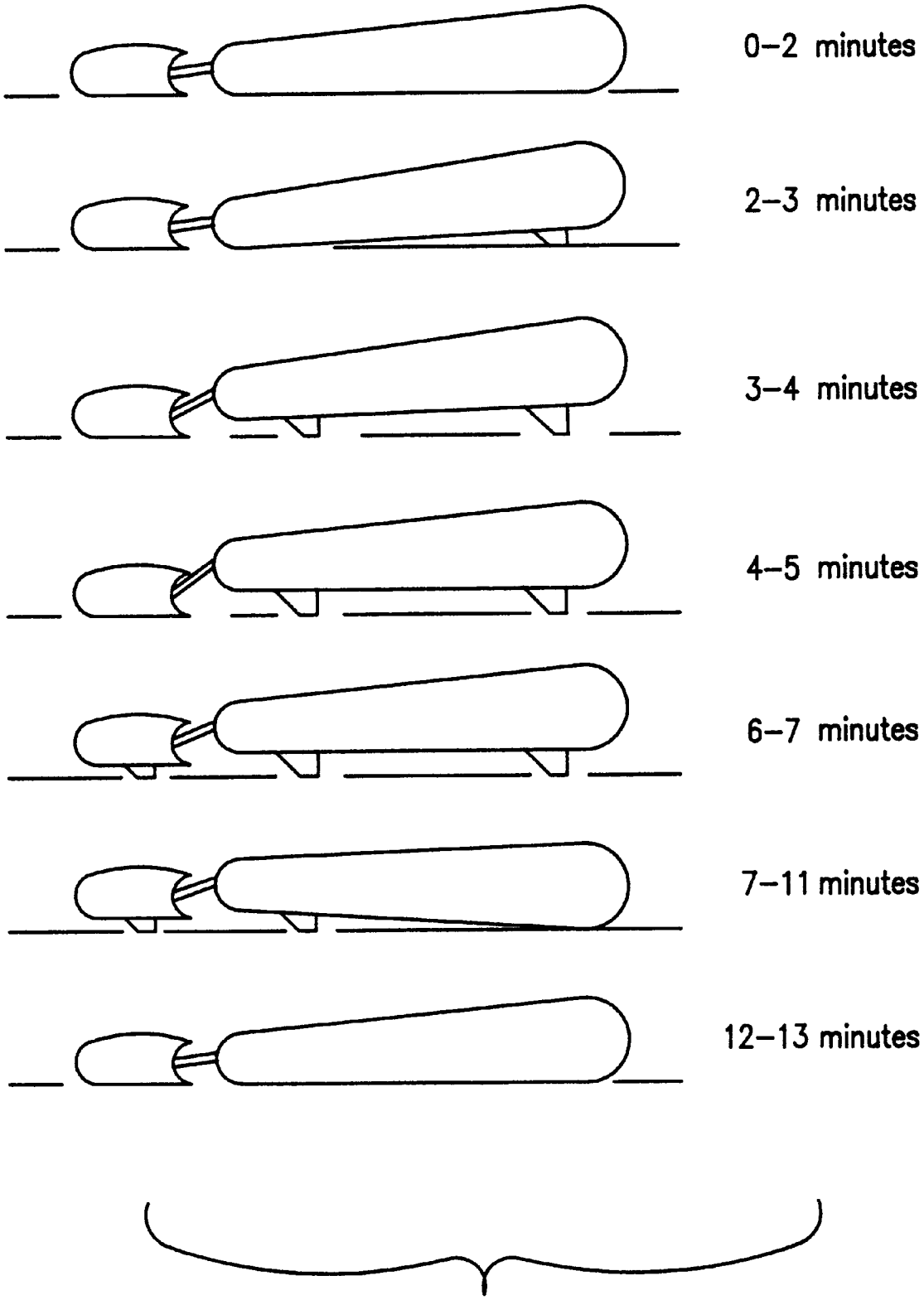
FIG. 8 illustrates the implementation of the height adjustment pattern of FIG. 7 for each adjustable section of the keyboard and wrist rest over time.

FIGS. 7 & 8 illustrate a sample pattern over time of movement of the rear, front, and wrist rest pairs. During the first two minutes, all legs are at their minimum adjustment (e.g. zero displacement); during the 2–3 minute period, the rear legs of the keyboard start to elevate; during the 3–4 minute period, the rear legs continue to elevate while the front keyboard legs start to elevate; during the 4–5 minute period, the rear legs reach maximum adjustment (i.e. full height obtainable); during the 6–7 minute period, the rear legs start to descend, the front legs reach maximum adjustment and the wrist rest legs begin to elevate; during the 7–11 minute period the rear legs descend to their minimum adjustment position, while the front and wrist rest legs obtain maximum adjustment; during the 12–13 minute period all legs are at minimum adjustment position. The cycle may then repeat or be truncated at some specified time or be changed by the user by a specific leg adjustment or a new pattern selection.

A very important aspect of the present invention, is that the computer controlled feature allows for infinite adjustment capabilities. Any number of programmable patterns can be designed and stored within the memory, limited only by memory storage space. Some very useful patterns would be sinusoidal or wave patterns, ramping patterns, quick period patterns to produce a massaging effect or replicate the patterns in music. In addition, the keyboard could be sent an impulse signal from the processor/computer which would produce a sudden noticeable height adjustment to indicate that you had just received an email message or have a voice mail waiting.

The computer PC hardware described throughout the disclosure is consistent with known IBM compatible, Macintosh or equivalent systems. The programming code to select specific motor controllers for actuation, or specific patterns for download, is considered to be within the scope of a computer programmer and can be modified without departing form the scope and spirit of the present invention.

CONCLUSION

A system and method has been shown in the above embodiments for the effective implementation of a computer controlled height adjustable keyboard. While various preferred embodiments have been shown and described, it will be understood that there is no intent to limit the invention by such disclosure, but rather, it is intended to cover all modifications and alternate constructions falling within the spirit and scope of the invention as defined in the appended claims. For example, the present invention should not be limited by size, materials, connection methods, leg styles, number or placement, processor elements, motors specifications, methods of transferring movement from the motors to the legs, specific user controller elements, patterns, or times for adjustment. The keyboard can be interchangeably configured with or without a wrist rest or include a fixed integrated wrist rest. Keyboard/wrist rest control is through controls located on the keyboard, a CRT GUI, or by remote wireless or rf control.

What is claimed is:

1. A height adjustable keyboard comprising:

a keyboard including a top and bottom surface;

one or more height adjusting supports extending from said bottom surface of said keyboard:

one or more motors operatively connected to said one or more height adjusting supports;

a processing element electrically connected to said one or more motors, and wherein said processing element selectively adjusts each of said one or more adjusting supports by operational control of said one or motors.

2. A height adjustable keyboard as per claim 1, wherein said height adjusting supports are legs and said keyboard comprises at least four of said legs located proximate to each corner of said keyboard.

3. A height adjustable keyboard as per claim 1, wherein said height adjusting supports are legs and said keyboard comprises at least four of said legs each with a corresponding motor.

4. A height adjustable keyboard as per claim 1, further comprising a motor controller operatively connected between each of said one or more motors and said processing element.

5. A height adjustable keyboard as per claim 1, wherein said processing element includes operator controls to select said processing element controlled height adjustments.

6. A height adjustable keyboard as per claim 5, wherein said operator controls include individual support controls.

7. A height adjustable keyboard as per claim 5, wherein said operator controls include a timer.

8. A height adjustable keyboard as per claim 5, wherein said operator controls include one or more of processing element controlled height adjustments by any of manual selection, timer, pattern selection, or by a GUI.

9. A height adjustable keyboard as per claim 1, wherein the height adjusting supports, motors, and processing element are encapsulated within a common structure which receives said keyboard in a retrofit arrangement.

10. A height adjustable keyboard as per claim 9, wherein said common structure further comprises operator controls to select said processing element controlled height adjustments.

11. A height adjustable keyboard as per claim 10, wherein said operator controls include one or more of processing element controlled height adjustments by: manual selection, timer, pattern selection, or by a GUI.

12. A height adjustable keyboard as per claim 1, comprising at least two height adjusting supports and wherein said selective adjustments are made by any of: continuous adjustment, incremental adjustment, patterned adjustment, timed adjustment or impulse adjustment.

13. A height adjustable keyboard as per claim 1, comprising at least two height adjusting supports and wherein said selective adjustments comprise separate adjustments made to each of said supports and comprise any of: continuous adjustment, incremental adjustment, patterned adjustment, timed adjustment, or impulse adjustment.

14. A height adjustable keyboard as per claim 1, further comprising a wrist rest, having a top and bottom surface and operatively connected to said keyboard, comprising one or more height adjustable supports and corresponding motors controlled by said processing element.

15. A height adjustable keyboard as per claim 14, wherein said wrist rest is tethered to said keyboard enabling relative movement between the keyboard and wrist rest.

16. A height adjustable keyboard as per claim 1, wherein solenoids are substituted for said motors.

17. A height adjustable platform as per claim 1, comprising at least two height adjusting supports and wherein said selective adjustments are made by any of: continuous adjustment, incremental adjustment, patterned adjustment, timed adjustment, or impulse adjustment.

18. A height adjustable platform as per claim 1, further comprising a wrist rest, having a top and bottom surface and operatively connected to said height adjustable platform, comprising one or more height adjustable supports and corresponding motors controlled by said processing element.

19. A height adjustable platform as per claim 18, wherein said wrist rest is tethered to said keyboard support surface enabling relative movement between the keyboard and wrist rest.

20. A height adjustable platform receiving a keyboard comprising:

a left and right housing connected by a keyboard supporting surface;

one or more height adjusting supports extending from a bottom surface of each of said housings;

one or more motors encapsulated within each of said right and left housings and operatively connected to said one or more height adjusting supports;

a processing element encapsulated within at least one of said right and left housings and electrically connected to said one or more motors;

said keyboard is retained on said keyboard support surface;

said processing element selectively adjusts each of said one or more adjusting supports by operational control of said one or more motors thereby modifying the height and angle of said keyboard.

21. A height adjustable platform as per claim 20, wherein said height adjusting supports are legs and said height adjustable platform comprises at least four of said legs located proximate to each corner.

22. A height adjustable platform as per claim 20, wherein said height adjusting supports are legs each with a corresponding motor.

23. A height adjustable platform as per claim 20, further comprising a motor controller operatively connected between each of said one or more motors and said processing element.

24. A height adjustable platform as per claim 20, wherein said processing element includes operator controls to select said processing element controlled height adjustments.

25. A height adjustable platform as per claim 24, wherein said operator controls include individual support controls.

26. A height adjustable platform as per claim 24, wherein said operator controls include a timer.

27. A height adjustable platform as per claim 24, wherein said operator controls include one or more of processing element controlled height adjustments by: manual selection, timer, pattern selection, or by a GUI.

28. A height adjustable platform as per claim 20, comprising at least two height adjusting supports and wherein said selective adjustments comprise separate adjustments made to each of said supports and comprise any of: continuous adjustment, incremental adjustment, patterned adjustment, timed adjustment or impulse adjustment.

29. A height adjustable platform as per claim 17, wherein solenoids are substituted for said motors.

30. A method of selectively controlling the height/angle of a keyboard comprising:

receiving user selected input of desired settings;

under processor control, selecting a pattern and timing of adjustment of one or more height adjustment mechanisms operatively connected to said keyboard, and under processor control, actuating one or motors connected to said one or more height adjustment mechanisms to implement said desired settings.

31. A method of selectively controlling the height and/or angle of a keyboard as per claim 30, wherein said height adjusting supports are legs and said keyboard comprises at least four of said legs located proximate to each corner of said keyboard.

32. A method of selectively controlling the height/angle of a keyboard as per claim 30, wherein said step of receiving user selected input of desired settings includes receiving input from an operator control console.

33. A method of selectively controlling the height and/or angle of a keyboard as per claim 30, wherein said desired user settings include individual support controls.

34. A method of selectively controlling the height/angle of a keyboard as per claim 30, wherein said desired user settings include a time selection.

35. A method of selectively controlling the height/angle of a keyboard as per claim 30, wherein said desired user settings include selection of one or more of: manual height adjustment, time, or pattern.

36. A method of selectively controlling the height/angle of a keyboard as per claim 30, wherein said desired user settings include selection from a computer displayed GUI.

37. A method of selectively controlling the height/angle of a keyboard as per claim 30, wherein said user desired settings include any of: continuous adjustment, incremental adjustment, patterned adjustment, timed adjustment, or impulse adjustment.

38. A method of selectively controlling the height/angle of a keyboard as per claim 30, further comprising receiving user selected desired settings for a height/angle adjustable wrist rest, having a top and bottom surface and operatively connected to said keyboard, comprising one or more height adjustable supports and corresponding motors controlled by said processing element.

39. A method of selectively controlling the height/angle of a keyboard as per claim 30, wherein solenoids are actuated instead of motors.

* * * * *

UNITED STATES PATENT AND TRADEMARK OFFICE

CERTIFICATE OF CORRECTION

PATENT NO. : 6,076,784
DATED : June 20, 2000
INVENTOR(S) : Edwin J. Selker

It is certified that error appears in the above-identified patent and that said Letters Patent is hereby corrected as shown below:

Column 8, Claim 29:
Line 18, delete "17" insert --20--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*